US005147218A

United States Patent [19]

Matthews et al.

[11] Patent Number: 5,147,218

[45] Date of Patent: Sep. 15, 1992

[54] PLUGGABLE MODULAR SPLICING CONNECTOR AND BRIDGING ADAPTER

[75] Inventors: Gary B. Matthews, Austin; Jerome A. Pratt, Leander, both of Tex.

[73] Assignee: Minnesota Mining and Manufacturing Company, St. Paul, Minn.

[21] Appl. No.: 684,323

[22] Filed: Apr. 12, 1991

[51] Int. Cl.[5] ..... H01R 4/24

[52] U.S. Cl. ..... 439/404; 439/651

[58] Field of Search ..... 439/395–408, 439/417–419, 651

[56] References Cited

U.S. PATENT DOCUMENTS

| | | | |
|---|---|---|---|
| 3,611,264 | 10/1971 | Ellis | 339/99 |
| 3,708,779 | 1/1973 | Enright et al. | 339/99 |
| 3,772,635 | 11/1973 | Frey et al. | 339/99 |
| 3,858,158 | 12/1974 | Henn et al. | 339/99 |
| 3,945,705 | 3/1976 | Seim et al. | 339/98 |
| 4,127,312 | 11/1978 | Fleischhacker | 439/403 |
| 4,162,815 | 7/1979 | Fleischhacker | 339/19 |
| 4,193,201 | 3/1980 | Van Horn | 439/403 |
| 4,262,985 | 4/1981 | Muehlhausen II | 339/99 |
| 4,272,147 | 6/1981 | Berglund et al. | 439/403 |
| 4,285,563 | 8/1981 | Crosier et al. | 339/45 |
| 4,552,429 | 11/1985 | van Alst | 439/404 |
| 4,952,169 | 8/1990 | Hays, Sr. | 439/402 |

OTHER PUBLICATIONS

3M Technical Report—4005-DPM Super Mate Pluggable Module/3M TelComm Products Division—1989.

*Primary Examiner*—David I. Pirlot

*Attorney, Agent, or Firm*—Gary L. Griswold; Walter N. Kirn; John C. Barnes

[57] ABSTRACT

A multiple wire-splice module for splicing a plurality of wires and for making a bridge connection to a 710 connector module uses multiple connector segments. The module has an elongate base for supporting the wires, which base will mate with an elongate body of insulative material having opposite surfaces, and the body supports a plurality of conductive contacts, each with a slotted wire receiving end portion, a second connecting member at the other end and a third connection portion intermediate the ends of the contact, the slotted insulation displacing wire receiving end portion is adapted to connect to a wire in the base when assembled and the second connecting member and the third connection portion are accessible at opposite sides of the base and body for connection to other modules. A bridging strip is adapted to connect the module to another splice module like a 710 connector.

11 Claims, 8 Drawing Sheets

PLUGGABLE MODULAR SPLICING CONNECTOR AND BRIDGING ADAPTER

BACKGROUND OF THE INVENTION

1. Field of the Invention

The present invention generally relates to a connector for multiple pairs of telecommunication wires, and more particularly to pluggable connectors for terminating multiple wire pairs and for connecting and disconnecting the connectors without exposing the wire-contact junctions, and for tapping into existing modular telephone cable splices to provide bridge transfer capabilities without service interruption.

2. Description of the Prior Art

Modular splicing for multiwire cable is described in U.S. Pat. No. 3,708,779, assigned to the assignee of the present application, which patent discloses a three layer splicing module usually including a base member, at least one body member, and a cover member. The body member consists of upper and lower segments to capture the contact elements, and the segments are welded together. Wires were placed in the transverse grooves in the base and in the grooves of the upper segment to make a splice. A cover is then placed over the upper surface of the upper segment. A splicing module is designed to splice corresponding pairs of wires in two cables. Additional connections to the spliced pairs can be made by placing another body member over the upper segment. To do this, the contacts of the next segment make another connection to the same wire in the upper segment then a third set of wires are joined in the upper segment of the second body member. In one embodiment the contacts have the U-connector for making the spring compression reserve, insulation displacement connection, an IDC, to the wire, and the U-connectors extend from one surface of the segment, and the other end of the contact is folded to make frictional locking engagement with another folded contact end, which other contact has its opposite end extending from the other segment and connected to a wire from another cable, see the description of FIG. 15 on column 5 lines 2–23, of this patent. Pressing the two segments together then causes the folded ends of the contacts to spring past each other, locking the two segments together and providing permanent electrical contact between the contact elements. In other aspects the module is the same as first described. U.S. Pat. No. 3,945,705 is directed to a similar connector and is directed solely to a splicing connector. This patent issued in March, 1976 and reflected improvements in the size of the connector.

U.S. Pat. No. 3,772,635, issued Nov. 13, 1973, and U.S. Pat. No. 3,858,158, issued Dec. 31, 1974, describe a splice connector with the added feature of an optional bridge connector for tapping into the splice. The bridge connector illustrated includes a double-ended slotted metallic contact element, one end of which extends through slots in the splicing module to make gripping contact with the narrow waist of the contact of the splicing module.

A further patent, U.S. Pat. No. 4,262,985, was issued in 1981, which discloses the Bell Telephone Laboratories wire splice module known commercially as the "710 Connector", which is a modular wire splicing connector with wire retaining members similar to the retainers used on the base of the connector of the present invention. Related patents include U.S. Pat. No. 3,858,158 (Devices for Making Electrical Connections; Henn, et al.) issued in December, 1974 and U.S. Pat. No. 3,611,264.

U.S. Pat. No. 4,127,312 (Modular Connector for Connecting Groups of Wires) issued in November, 1978 and U.S. Pat. No. 4,162,815 (Means for Cable Section and Equipment Transfer Without Service Interruption) issued in July, 1979. These patents disclose stackable connectors having contacts which include a wire receiving slot and a receptacle portion. The contacts are received in a body and extend between the faces thereof permitting the body with the wires joined to the wire receiving portions of the contacts to be mated at either face with another similar body. Contact with another module has to be made however adjacent the junction to a wire and this often requires further insulation displacement. This connector structure also requires exposing the wire contact junctions for splicing and plugging on additional modules.

U.S. Pat. No. 4,285,563 (Cable Connector and Cap Shoe Therefore), issued in August, 1981, discloses equipment and methods which allow testing and working transfers of a modified 710 connector. The spring loaded pins which were to be insertable into the module were not as reliable to maintain service while performing the bridge transfer function.

Commercially available connectors also include the Super Mate pluggable module, sold by the assignee of this application, which utilizes a strip with contacts to make an insulation displacement connection with the wire and the other end of the pluggable contact is twisted 90° to afford contact with a leg of another bifurcated U element adapted to receive another wire. Again, the separation of the elements to disconnect any of the spliced wires, leaves a set of wires and the junction with the contact element exposed.

These prior art devices, if they provide a stackable feature or a pluggable feature, when plugging to another module with an additional set of wires, includes a second connection to the same set of wires, or a connection to a leg of another contact element which is often covered with the wire insulation displaced by the wire connection. In either event this requires exposing the junction of the wire and contact to make an additional connection to the wires. Further, when unplugging one set of wires from another, to disconnect a module in a stack, there is the need to expose the wire-contact junctions, developing the opportunity for one or more junctions to become lost and causing any encapsulating grease to be displaced from the junction.

The present invention, together with the fact that the connector modules are usable with a bridge adapter to bridge to an existing splice module, provides an improved splicing structure and one which is usable with existing splicing fixtures.

SUMMARY OF THE INVENTION

The present invention provides a multiple wire-splice module for use in the telecommunications industry to splice many pairs of wires. The module comprises an elongate base, formed of an insulating polymeric material, having opposite longitudinal sides and surfaces. Slotted openings extend through the base between the surfaces along one side and wire retaining members are positioned along the opposite side of one surface forming channels for receiving the wires. An elongate body of insulative material having opposite surfaces mates with the base. The body supports a plurality of conductive contacts. Each contact has a bifurcated wire receiving end portion and a second connecting member at the other end for making an electrical connection to another connecting member. A third connection member is formed intermediate the ends of the contact. The body has an access opening affording access to the third connection member from one surface and the opposite surface is directed toward the base with the bifurcated end portion positioned to engage a wire in the base. The second connecting member is directed to extend through the slotted opening in the base to connect with another connection member when the base and body are assembled.

The wire splice module is adapted for use as a splicing module by having a plurality of the modules connected together. It is also usable to make a bridging connection to a completed splice, by adding a bridging strip adapted for connection to another splice, e.g. a 710 connector. This bridging connection is afforded by a bridging strip having a plurality of bridging contacts each with a forked connecting member positioned in a plane parallel to the length of a bridging strip, and a connecting tab positioned in a plane parallel to the length of the bridging strip. The bridging strip comprises a first elongated support strip having means for accommodating a plurality of spaced bridging contacts and a mounting strip adapted to mate with the support strip for holding the bridging contacts in place with the forked connecting members extending from one side thereof and with the connecting tabs positioned in slotted openings formed on the opposite side thereof.

The contact of the splicing module is novel in that it makes three separate connections and making one connection does not interrupt another.

BRIEF DESCRIPTION OF THE DRAWING

The present invention will be further described hereinafter with reference to the accompanying drawing wherein.

DESCRIPTION OF THE PRESENTLY PREFERRED EMBODIMENTS

Figure 9:
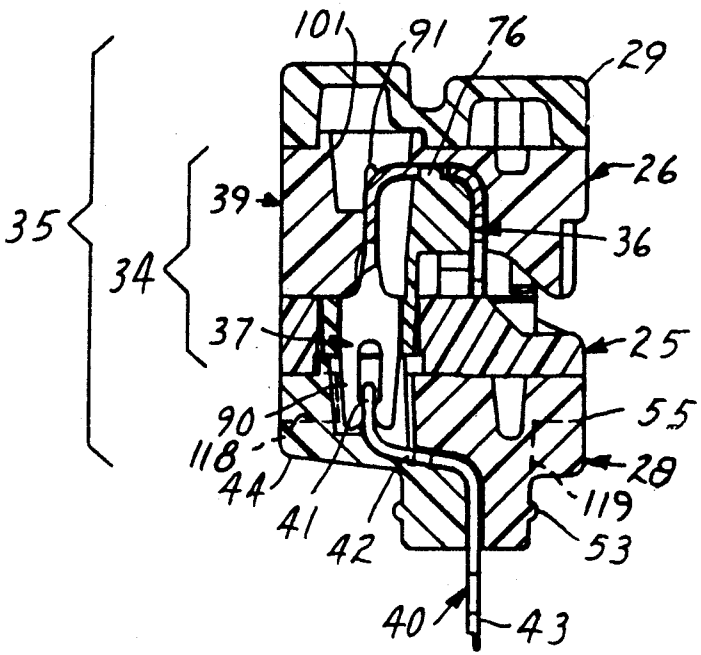
FIG. 9 is a transverse sectional view of the wire-splicing module and bridging connector strip of the present invention.

The multi-pair wire splicing system of this invention will now be described in greater detail with reference to the accompanying drawing wherein like reference numerals refer to like parts throughout the several views. The present invention provides a splicing system which has, as unique features, a pluggable connector comprising a body with contact elements and a base, between which wires are positioned and connected and the module is then pluggable and unpluggable without exposing the wire junctions again. Further, the contacts are in a single row and may be pluggable to another module at either the top or bottom surface of the module. An adapter or bridging strip is used to make it compatible with other existing splice modules, e.g. the illustrated bridging strip is compatible with the 710 connector.

The wire splicing system of the present invention comprises a plurality of components, several of which are formed of a plurality of molded and stamped parts. The molded parts are formed of an electrically insulating polymeric material. The stamped parts, the contacts or connector elements are formed from a copper alloy material, such as phosphor bronze. The basic components of the splice module 34 comprises a base 25 and a body 26. The bridging connector 35 comprises a base 25, a body 26, a bridging strip 28, and a top cover 29. A bottom cover 110 is provided to protect the contact elements when making wire connections to a body 26 and to enclose the elements when making a multiwire splice. Combinations of these components, and often duplicates of some parts are used to perform bridge transfers without interrupting service. The basic wire splice module 34 permits stacking, splicing or connecting multiple wires from two or more different cables together, or connecting the wires of one module to the bridging strip 28, to define a pluggable bridge connector 35 for making a bridge connection to a 710 connector.

The system of the present invention affords the use of existing wire connecting and splicing fixtures used for the 710 splice modules. Cover 29 is used to protect the body 26 from the cutting blades of the splicing fixture. Cover 110 is used to support the base 25 in the splicing fixture.

Figure 1:
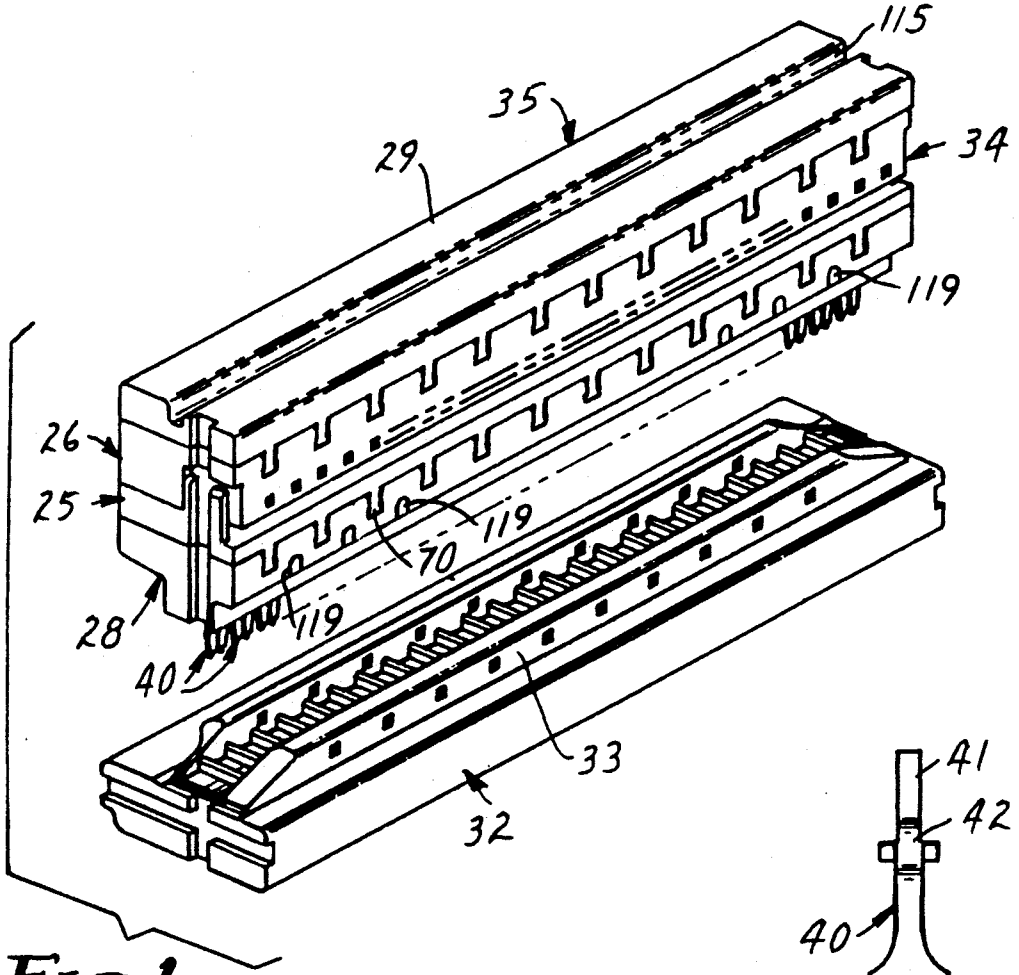
FIG. 1 is a perspective view of a 710 connector and a bridging connector according to the present invention.

Referring again to the drawing, FIG. 1 illustrates a 710 connector 32 which is formed to connect wire pairs from a pair of cables as is disclosed in U.S. Pat. No. 4,262,985. The 710 connector has a bridging rail at 33 which comprises spaced ribs and a plurality of slots which form access ports in the side of the connector 32 to the contacts joining pairs of wires, see FIG. 2. The present invention provides a pluggable bridge connector as indicated at 35 which serves to access the wires in the connector 32 to perform a bridge connection which can be transferred without interrupting service to the customers on the lines connected through the pluggable bridge connector. The bridge connector 35 is indicated in contacting relationship with the 710 connector in FIG. 2, where the contacts 30 of the connector 32 are shown in electrical contact with the contacts 40 of the pluggable bridge connector 35.

Figure 2:
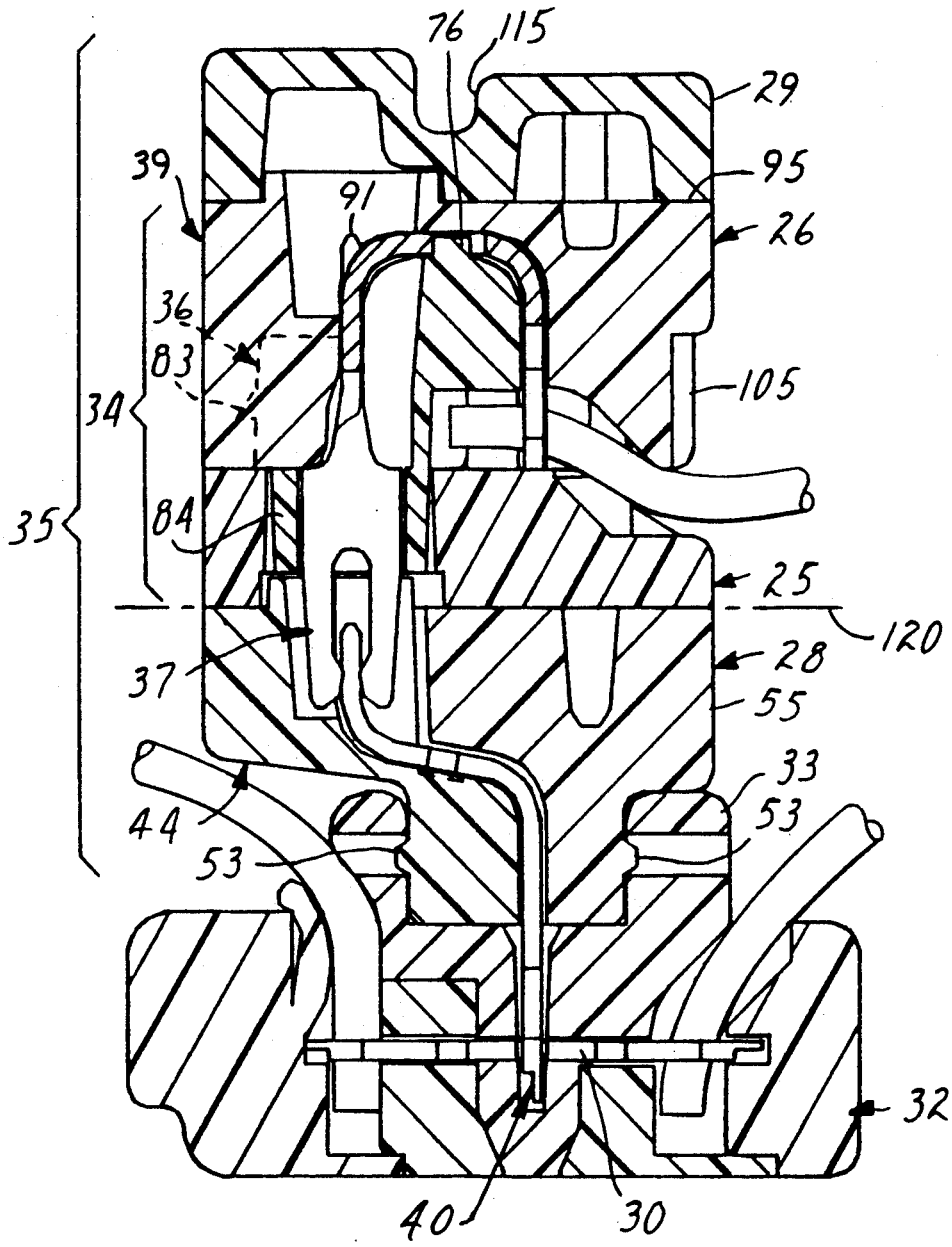
FIG. 2 is a transverse sectional view of a bridging connector according to the present invention and a partial transverse sectional view of a 710 connector showing the wires in the 710 connector and wires in the bridge connector of the present invention.

The bridge connector 35 comprises a bridging strip 28, a base 25, and a body 26. As illustrated in FIG. 2, a top cover 29 is positioned above the body 26.

Figure 4:
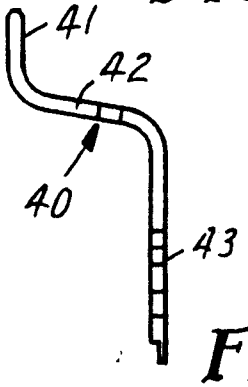
FIG. 4 is a side view of the bridging element of FIG. 3.
Figure 3:
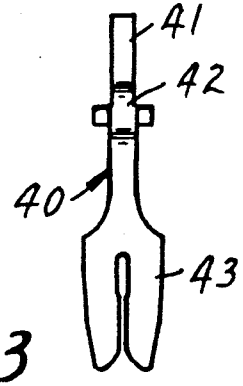
FIG. 3 is a front elevation of a bridging element.
Figure 6:
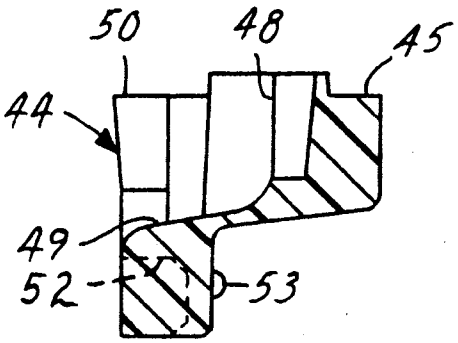
FIG. 5 is a fragmentary top view of a support strip and FIG. 6 is a sectional view of the support strip of FIG. 5.

A splicing module 34 comprises the elongate base 25 and body 26, which body 26 comprises an elongate insert 36, a plurality of contacts 37 and a cap 39. The body 26, as a unit can be placed on the wires of a 25 pair cable which have been placed in the base 25 and cut by the fixture, to make connection therewith, and the wires and body 34 are adapted to be plugged to another splicing module 34 or to a bridging strip 28. The bridging strip 28 comprises a plurality of contact elements 40 as shown in FIGS. 3 and 4 which comprises a pluggable blade element or connecting tab 41 at one end, an intermediate support portion, including flanges, 42, and a connecting portion 43, which is in the form of a bifurcated plate contact with a pair of spaced legs adapted to make resilient contact with the waist section of the contact elements 30 of the 710 connector, or the like, as clearly illustrated in FIG. 3. The contact element 40 is supported by a support member 44, illustrated in FIGS. 5 and 6, which has a first surface 45 formed with oblong recesses 46 and circular recesses 47, of no function except to space a series of walls which project slightly above the surface 45 and define the upper end of slots 48, which slots are positioned therebetween. The slots 48 have a wide portion and a stepped portion of narrower width extending toward one side in the upper surface. A shoulder formed at the transition therebetween, locates the tab 41 of the contact element 40, and a seat portion 49 thereof supports the intermediate portion 42 of the contact element 40. A contact 40 is placed in each slot 48. Projecting from one edge of the surface 45 of the support member 44 are a plurality of truncated arrowhead shaped projections 50 and, formed in the same edge of the support member 44, adjacent the opposite surface of the support member, are generally circular recesses 52. The projections 50 and recesses 52 form means for locking the support member 44 and a locking strip 55 together to form the bridging strip 28. The support member 44 is formed with nibs 53 on one side to engage a catch or opening in the 710 connector bridge rail 33. The support member 44 is also formed with recesses 118, in the surface 45 between the recesses 71, for receiving the prongs of a tool used to separate the bridging strip 28 from a base member 25.

Figure 8:
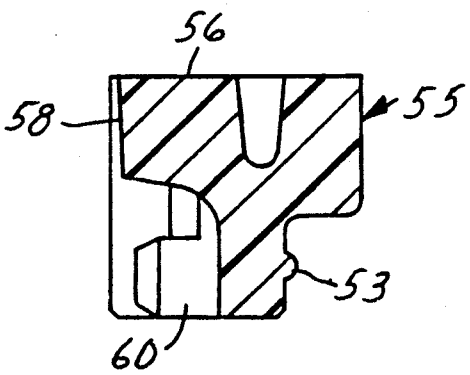
FIG. 7 is a fragmentary top view of a mounting strip and FIG. 8 is a cross-sectional view of the mounting strip which, with the bridging elements and support strip, form the bridging strip of the bridging connector of FIGS. 2 and 9.
Figure 7:
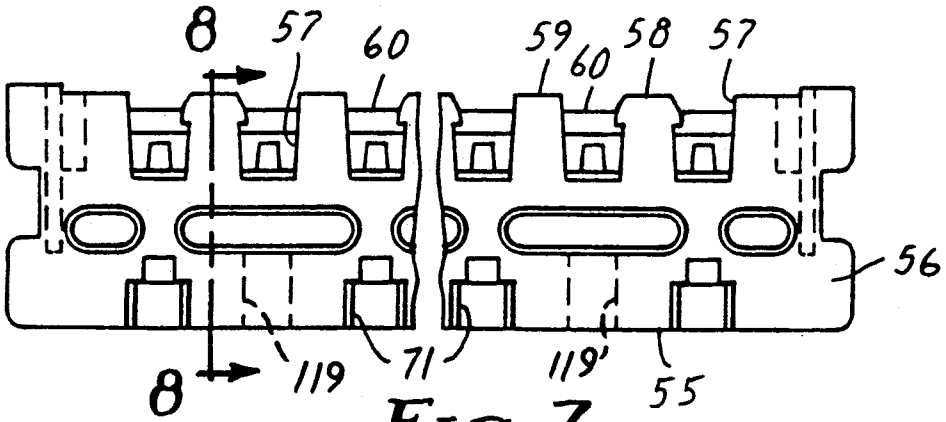

The locking strip 55 is illustrated in FIGS. 7 and 8 and comprises a surface 56 which is positioned generally parallel to the major surface 45 of the support member 44, along one edge of which is formed alternately, a slotted recess 57, a catch 58, of mushroom shape in plan view to provide teeth on the sides thereof, a recess 57 and a wedge-shaped projection 59, another recess 57, etc. along the side of the strip 55. Along the same side and below each recess 57 are plugs 60 which are generally cylindrical to enter and engage the circular recesses 52 of the support member 44. Thus the locking strip 55 can serve to lock the contact elements 40 into position in the slots 48 with the tabs 41 thereof located against the shoulder in the slots 48 and the openings remaining, defined by the narrow portion of the slots 48 and the space between the ends of the catches 58 and projections 59, allow access to the tabs 41. The wide portion of the contacts 40 forming the bifurcated connecting portion 43 extend from the opposite surface of the locking strip 55, from between adjacent plugs 60 and beyond, to a position where they are adapted to penetrate the slots in the bridging rail 33 of the 710 connector 32 to make contact with the waist section of the wire contacts 30, as shown in FIG. 2. Locking strip 55 is also provided with nibs 53 on the side surface opposite the plugs 60. The nibs 53 on the sides of the bridging strip 28 engage a catch or openings in the 710 connector bridge rails 33, as shown in FIG. 2, to hold the bridging strip in place. The locking strip 55 is formed with recesses 119, see FIG. 1 and FIG. 7, which are positioned to receive a separating tool for separating a bridging strip 28 from a 710 connector bridging rail 33. Thus, the recesses 118 in the support member 44 aid in the separation of a base from the bridging strip 28 and the recesses 119 in the locking strip 55 aid in the separation of the bridging strip 28 from the 710 module bridging rails 33, by the placing of a separation tool in the recesses and forcing one component in one direction and the other component in the opposite direction in alternate holes along the length of the bridging strip 28.

Figure 11:
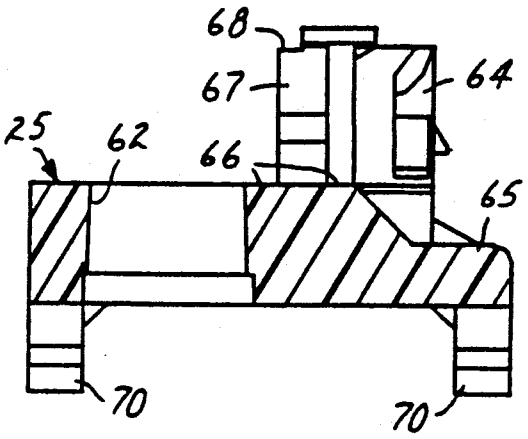
FIG. 10 is a top view of a base for receiving the wires and FIG. 11 is a cross sectional view of the base of FIG. 10.
Figure 10:
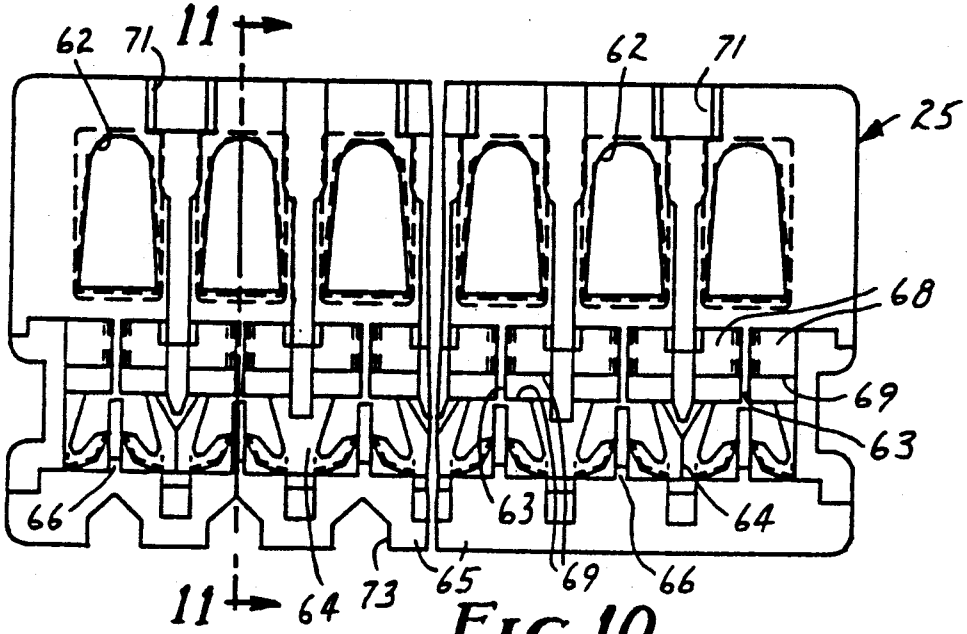

FIG. 9 illustrates a cross-section of a bridge connector 35, which is adapted to connect a plurality of wire pairs with the 710 connector. The connector comprises the bridging strip 28, the module 34 and cover 29. The base 25 of the module 34 is illustrated in FIGS. 10 and 11 and comprises a plurality of transverse openings 62, extending between the major surfaces of the base, and a ridge formed by wire retaining members positioned along the surface adjacent the other longitudinal edge of the base. The retaining members comprise a plurality of spaced teeth 64 which rise vertically from the surface. Alternate teeth 64 have a radiused top and the other teeth 64 have a pointed top. Each tooth is set back slightly from the side edge to create a narrow ledge 65. Between adjacent teeth 64 are wire receiving channels 66. Between the teeth 64 and the openings 62 are arms 67 which are formed by two vertical slots in a dome-roofed riser 68. The spaced arms of adjacent risers 68 further define the wire channels 66 which are aligned with the openings 62. With no wire in the channels, the arms 67 are generally parallel and separated by a constant distance. When a wire is introduced in the channel 66, the arms 67 are deflected away from each other in the region of the wire and toward each other in the area between the channels 66. There is also movement of the arms 67 toward each other above the wire in the channel. Also the teeth 64 have side portions that are deflected upon entry of a wire in the channel such that a wire is retained from axial as well as lateral displacement. The surface of the base 25 is deeply grooved between the teeth 64 and the arms 67, transversely of the channels 66, except for narrow wire supporting ribs 63 extending along the center of each channel 66 to support the wires. The grooves 69 are formed to receive the bifurcated wire receiving contacts to be hereinafter described. The bottom surface of the base 25 has a plurality of spaced legs or teeth 70 which are adapted to be received in edge notches 71 which appear in the side walls and adjacent top surface of the bridging strip 28 and in the edge walls and top surface of the body 26. The top surface of the base also has recesses 71 along one side to mate with teeth 70, of the same size and shape, on the cap 39 of the body 26, and barbs projecting outward from the teeth 64, to permanently lock the body 26 and base 25 together.

The base 25, in one embodiment, may be provided with notches 73, as illustrated in FIG. 10, in the ledge 65 along one side of the base. The notches 73 afford means for positioning the wire ends of the wires when a half-tap connection to the splicing module is terminated. To make a half tap with the module 34, the wire is introduced into the base 25 between the teeth 64 and arms 67 and then it is looped back through the same channel between the same arms and teeth. When it is desired to terminate the half tap, the wire is positioned in the notch 73 and cut, usually the wire in the bottom of the channel 66 is cut, and the cut end is placed in the notch 73 to be subsequently covered by an electrically insulating material.

Figure 13:
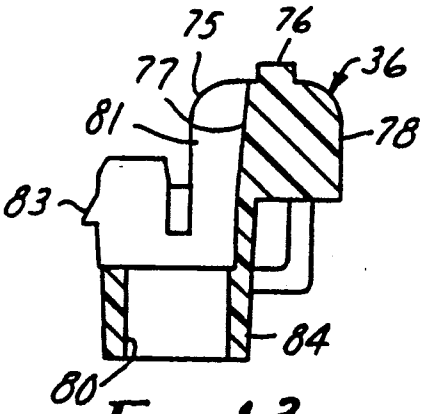
FIG. 12 is a fragmentary top view of an insert and FIG. 13 is a cross sectional view of the insert taken along line 13—13 of FIG. 12.
Figure 12:
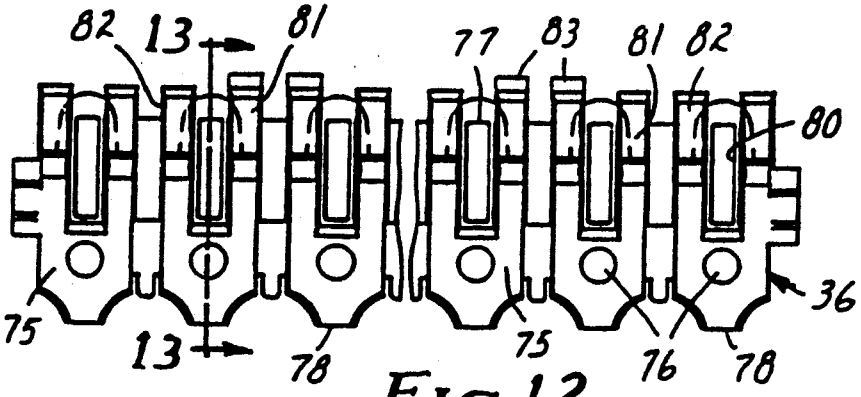

The body 26 comprises the insert 36, shown in FIGS. 12 and 13, a plurality of contacts 37, and a cap 39 assembled as will be hereinafter explained. The insert 36 affords means for supporting the contacts during assembly and thereafter against the forces occurring during connection and disconnection. The insert 36 is an elongate strip having a ridge formed along one edge, which ridge is defined by a plurality of projections 75 each having a small locating button 76 on the very top, a slot 77 on one side and a stand-off projection 78 on the opposite side. The slots 77 communicate with narrower side-by-side openings 80 which extend through the insert 36. The slots 77 are defined by spaced walls 81 and 82, one of which is formed with a latching tooth 83, at patterned intervals. The narrower openings 80 are formed in depending projections 84 which are adapted to be received in the transverse openings 62 of the base 25 to increase the dielectric path between contacts.

Figure 14:
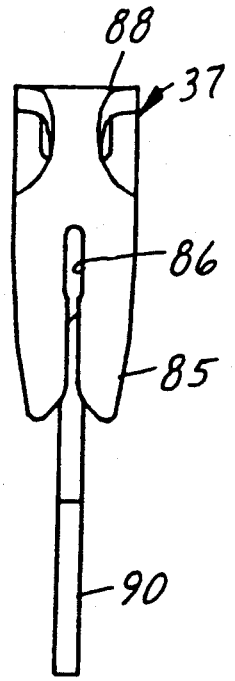
FIG. 14 is a front elevational view of a contact.
Figure 15:
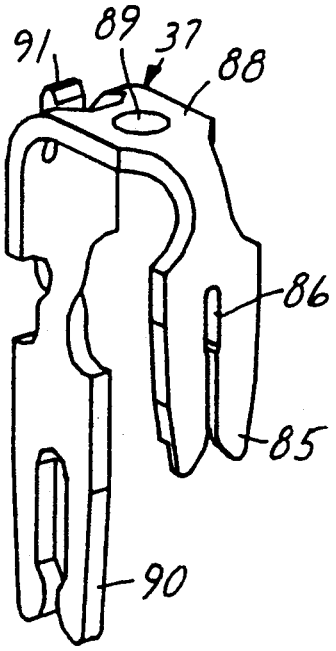
FIG. 15 is a perspective view of a contact.
Figure 16:
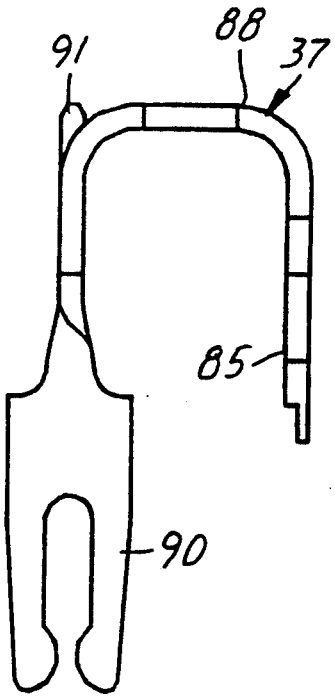
FIG. 16 is a side elevational view of a contact.

A contact 37 is mounted on each projection 75 and the ends of the contact 37 are positioned on opposite sides of the ridge. As illustrated in FIGS. 14, 15 and 16, the contacts 37 generally comprise a U-shaped resilient conductive member having a bight portion 88 having opposite sides and ends intermediate a pair of legs of different length extending from opposite ends of the bight portion 88 but in the same direction. One of said legs define a bifurcate connector plate 85 disposed in a first plane and deeply grooved to form a slot 86 for affording insulation displacing spring reserve electrical connection with a wire. The narrow edges defining the slot 86 are generally parallel and the plate 85 includes smoothly diverging terminal portions defining a wire-accepting opening. The second leg of the U-shaped contact 37 is formed with a twist to dispose the free end thereof in a plane generally perpendicular to plane of the plate 85. The second end portion of the contact 37 has a connecting means 90, either a male or female connector, on the free end for making a second electrical connection. The second electrical connecting member 90 as illustrated is a female tuning fork type connector member. The contact 37 is also formed with a cut or U-shaped slot in the second leg adjacent the end of the bight portion 88 for forming a second male or female connecting means 91 on the second leg for making a third electrical connection to a cooperating connecting member 90 or to a cooperating contact on a test device or to a test probe. As illustrated, the connecting means 91 is a tab formed by a U-shaped slot being cut in the corner of the bight portion and the second leg so the tab projects in a direction opposite the direction of the connecting means 90. Thereby, a connection can be made to a wire in a first plane parallel to the bight portion 88, in a second plane spaced further from the bight portion and in a third plane adjacent the bight portion, through a clearance opening 101 in the top of the body 26.

The end portion or plate 85 is positioned along one side of the ridge of the insert 36 with the slot 86 between the legs thereof extending transversely to the ridge and aligned with the stand-off 78 of the insert 36. The intermediate bight portion 88 of the contact is provided with an opening 89 to receive the button 76 of the projections 75 to position the contact 37. The 90° twist in the second leg, positions the legs of the connecting member 90 in a plane generally perpendicular to the end portion 85.

The tuning fork type connecting member 90 in the end portion of the leg is positioned to depend from the projection 75 into and through the opening 80 in the insert. The tab 91 projects above the forked end and is a thin-blade like member disposed in a plane in angular relationship to the plane of the legs of the tuning fork contact 90.

Figure 18:
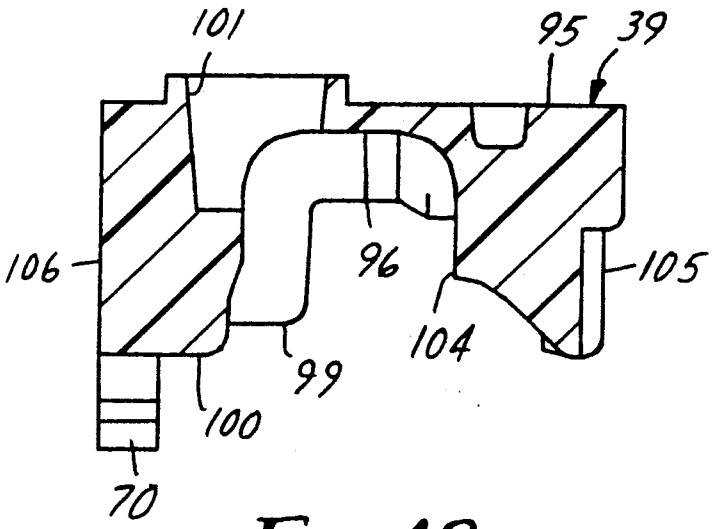
FIG. 17 is a fragmentary bottom view of a cap and FIG. 18 is a cross-sectional view of the cap of FIG. 17.
Figure 17:
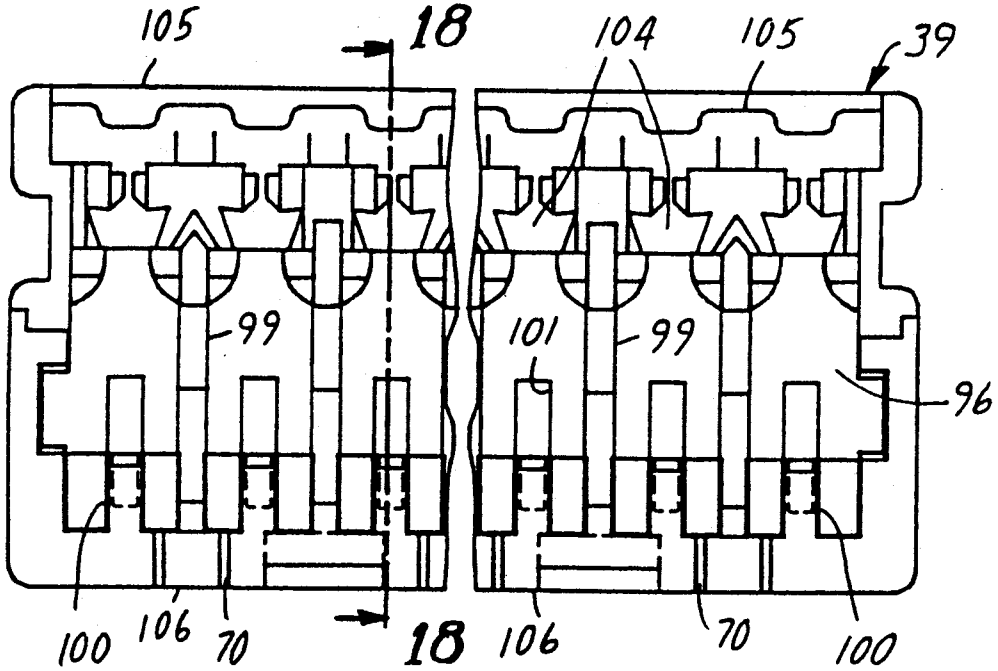

A cap 39 is formed to fit over the insert 36 and lock the contacts 37 onto the insert and into the cap. The cap comprises a first surface 95 and an opposite lower surface 96, formed of numerous spaced wall members, ribs and locking and aligning projections, as illustrated in FIGS. 17 and 18. Spaced walls 99 are separated by ribs 100. The ribs 100 are aligned transversely with through openings 101, into which the tabs 91 project to afford access to the tabs 91. Opposite the ribs 100 are inwardly projecting supporting and locking projections 104 which support the side of the end portion 85 of the contact 37 opposite the stand-off 78 of the insert 36 and receive therebetween the teeth 64 of the base 25. One side wall 105 of the cap 39 extends along the wire receiving contact end portions 85 and the opposite side wall 106 is positioned adjacent the connecting member 90, except the connecting members 90 extend substantially past the lower edge of the wall 106 and the projections 84 of insert 36 when the body 26 is assembled. The cap 39 also has teeth 70 projecting from the surface 96 which are mateable with recesses 71 in the edges of the base 25. Recesses 71 are also formed along each of the edges of surface 95 to receive the teeth 70 of another base 25 or of a cover 29. The cap 39 has spaced recesses corresponding to the recesses 118 in the side 106 and surface 95, in alternate fashion with notches 71, along the length of the cap for receiving the separating tool.

Figure 19:
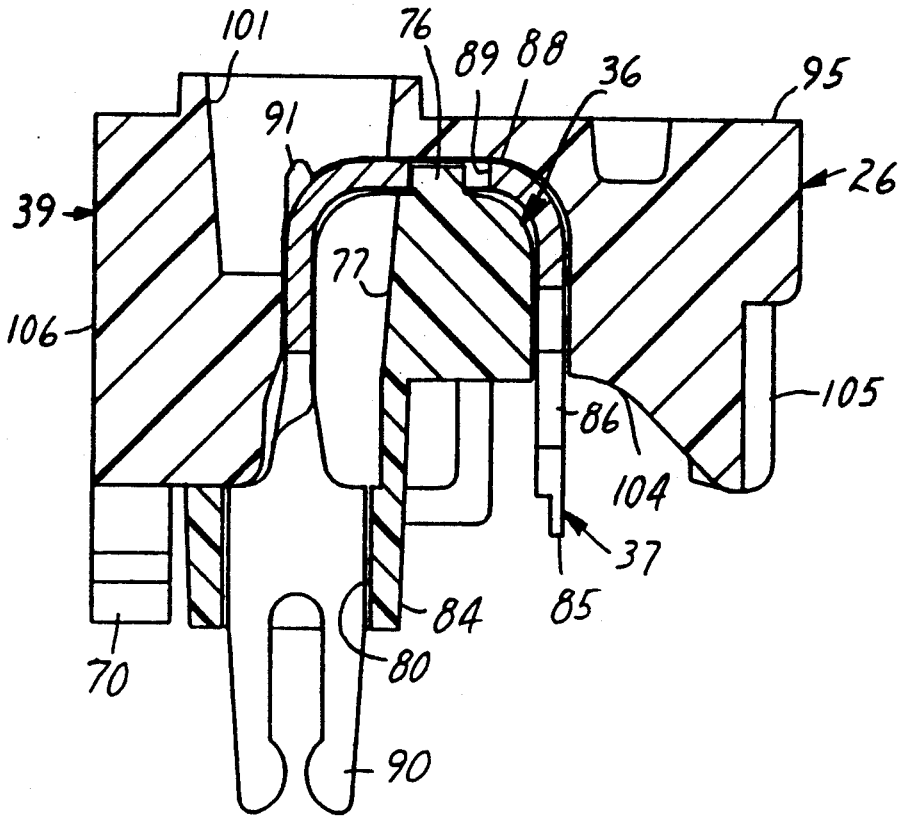
FIG. 19 is an cross sectional view of the insert, contacts and cap joined together to form the contact assembly or body.

The assembled body 26 including the insert 36, contacts 37 and cap 39 is illustrated in FIG. 19.

Figure 20:
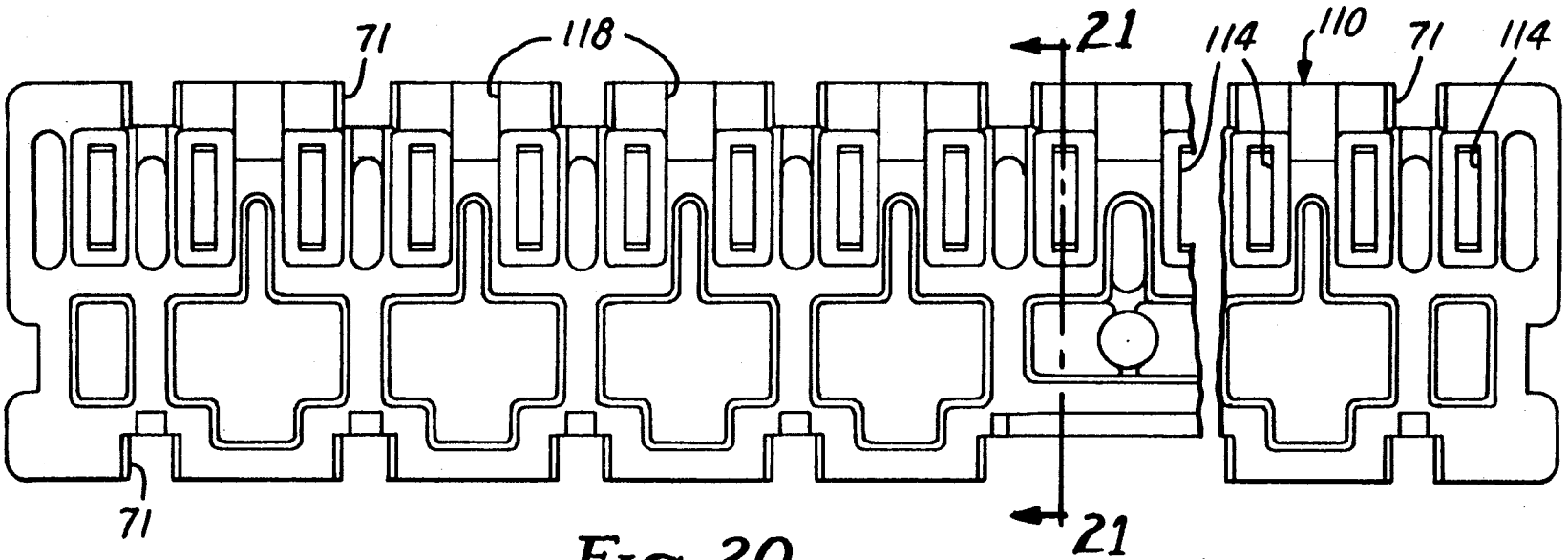
FIG. 20 is a fragmentary bottom view of a bottom cover for the body and FIG. 21 is a sectional view of the bottom cover of FIG. 20.
Figure 21:
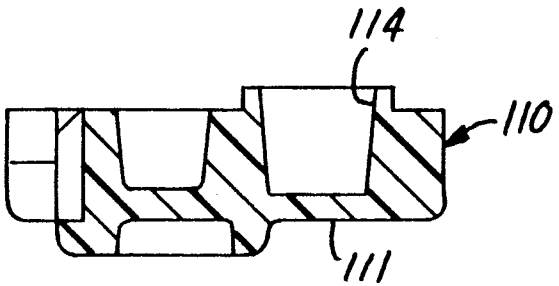

The bottom cover 110 is illustrated in FIGS. 20 and 21. This cover 110 is adapted to be fitted to the lower side or surface of a base 25 to support the same in a fixture for assembling wires in a base and to support the base when pressure is applied to make the wire connections with a body 26. The base has a generally smooth outer surface 111 and the inner or top surface as shown in FIGS. 20 and 21 has a series of pockets. One set of pockets 114 are formed to receive the connecting members 90 of the contacts 37. This cover is also provided with recesses 71 along the marginal sides and surfaces to receive the teeth 70 of a base 25. Additional recesses 118 are formed in the cover 110 along a side and inner surface to receive a tool for separating the bottom cover from a base.

The top cover 29 is similarly formed to provide a support for the upper surface of the body 26 such that when force is applied thereto the force is transferred to the cap 39 evenly and such force is not received by the projections which extend slightly above the surface 95. The top cover 29 is provided with a longitudinal groove 115 to provide a clearance slot for the cutting blade of the splicing fixture.

Figure 5:
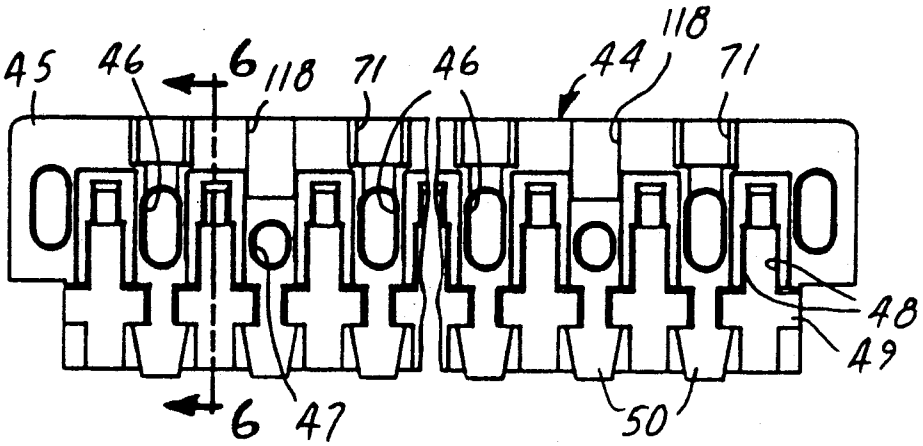
Figure 22:
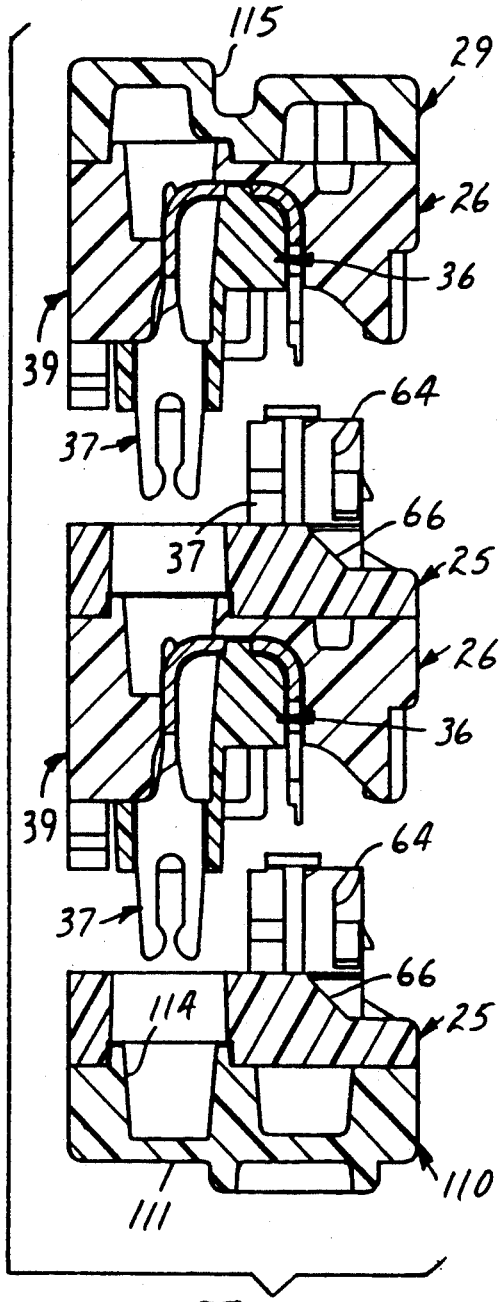
FIG. 22 is an exploded cross-sectional view of the splice connector components, including, viewed from the top down, a top cover joined to a body, a base joined to a body, another base and a bottom cover.
Figure 23:
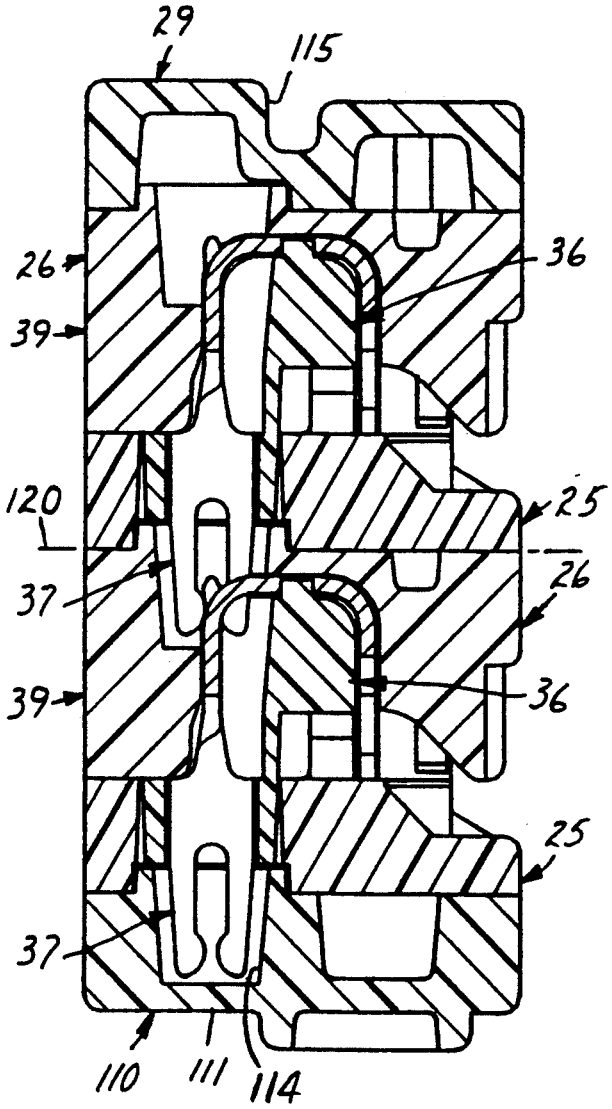
FIG. 23 is a transverse sectional view of the components of FIG. 22 assembled, but without the wires in place, to illustrate the interconnection of the contact members.

FIG. 22 illustrates the use of two wire splicing modules to join or splice pairs of wires from two cables. The bottom cover 110 supports a first base 25 in a fixture. Wires from a first cable are placed into the wire channels 66 between the teeth 64 and arms 67. The fixture is operated to cut the wires. A body 26 is then placed over the first base 25 and each contact 37 makes an insulation displacing electrical junction with one of the wires in a channel 66. A second base 25 is attached to the surface 95 of the cap 39 and wires from the second cable are threaded between the teeth. The fixture is again operated to cut the wire ends. Now a second body member 26, having a top cover 29 thereabove, is positioned over the second set of wires and the fixture closes the second body onto the second set of wires making a insulation displacing connection to the wires, and also the splicing of the wires by the contacting portion 90 of the second set of contacts making electrical contact with the tab 91 of the first set of contacts. If it should be desirable to separate the splice, the components are separated between the second base member 25 and the first body 26. When this is done, the electrical junctions between the wires and the contacts in the plates 85 of the contacts 37 of either module 34 are not exposed which may allow a separation of the wire from the contact. Furthermore, any insulative and encapsulating grease placed in the connector to protect the contacts at the wire junction remains to protect the junction. The finished splice is illustrated in section in FIG. 23, except the wires are omitted for purposes of illustration. Recesses, similar to the recesses 118 in FIGS. 5 and 20, are formed in the front wall 106 of cap 39 adjacent the surface 95 to accept a tool for separating the cap 39 from a base 25 or a cover 29. Again, separation at the line 120 as illustrated in FIG. 2 and FIG. 23, or separation of the covers from the module 34, does not expose the junctions of the wires with the contacts 37. A top cover or a bottom cover can be removed to expose the connection tabs 91 or the contacts 90, respectively, to make additional connections to the cables. Removal of the top cover 29 of the upper body 26 exposes the tab 91 to permit even further connections to be made as is necessary in working bridge transfers from one cable to a new cable without interrupting service.

Having disclosed the preferred embodiment of the invention, it is to be appreciated that changes may be made therein without departing from the spirit or scope of the invention as recited in the appended claims.

We claim:

1. A multiple wire-splice module comprising an elongate base formed of an insulating polymeric material having opposite longitudinal sides and opposite surfaces, with slotted openings extending through said base between said surfaces along one side and wire retaining members positioned along one surface adjacent the opposite side forming channels for receiving the wires, an elongate body of insulative material having opposite surface, said body comprising an elongate insert having a ridge extending the length of said insert, and a plurality of openings positioned along the length of the insert and extending therethrough, a plurality of conductive contacts, said contacts being supported on said ridge of said insert, each said contact having a bifurcated wire receiving end portion positioned along a side of said ridge with the slot between the legs thereof extending transversely to said ridge, a second connecting member at the other end of each contact being positioned on the other side of said ridge and extending through a said openings in said insert and beyond the side of the insert opposite the ridge, and a third connection portion intermediate the ends of the contact, and a cap positioned over said insert, said cap having side walls and a top wall, the inner surface of the top wall forming means to capture the contacts between the cap and said insert, said bifurcated wire receiving end portion being adapted to connect to a said wire in a channel of said base and said second connecting member and said third connection portion being accessible at opposite surfaces of the base and body, when said base and body are assembled with a wire junction being formed therebetween.

2. A multiple wire-splice module according to claim 1 wherein said base and said body are formed with interlocking teeth and recesses along the length thereof for permanently holding the base and body together to maintain the junction of the contacts and wires secure.

3. A multiple wire-splice module according to claim 1 wherein said base and said body are formed with interlocking teeth and recesses along the length thereof for permanently holding the base and body together to maintain the junction of the contacts and wires secure.

4. A multiple wire-splice module according to claim 1 wherein said cap is formed with a plurality of openings arranged in a row, with the openings positioned to receive a said second connecting member of a second wire-splice module to interconnect with said third connection portion.

5. A multiple wire splice module according to claim 1 wherein said module comprises bridging means for making connection with the contacts of a 710 connector having bridging slots in one side thereof to make connection with the contacts of a said 710 connector, said bridging means including a bridging strip having opposite longitudinal surfaces and a plurality of bridging contacts each with a forked connecting member positioned in a plane parallel to the length of the bridging strip, and a connecting tab positioned in a plane parallel to the length of said strip, and said bridging strip having openings along one surface to afford access to said tabs and having said forked connecting members extending from the opposite surface.

6. A multiple wire-splice module according to claim 5 wherein said bridging strip comprises a first elongated support strip having means for accommodating said bridging contacts and a mounting strip adapted to mate with said support strip for holding said bridging contacts in place with said forked connecting members extending from one surface thereof and with said connecting tabs positioned in said openings formed on the opposite surface thereof.

7. A multiple wire-splice module comprising:

an elongate base formed of an insulating polymeric material having opposite longitudinal sides with a row of slotted openings extending through said base along one side and wire retaining members positioned along the opposite edge with channels formed therebetween for receiving the wires, said channels for retaining the wires being aligned with the slotted openings positioned along the opposite side, an elongate insert having a plurality of side-by-side openings extending therethrough and means defining a ridge for supporting contacts, said ridge extending the length of said insert along one side thereof, a plurality of contacts supported on said ridge of said insert, each said contact having a bifurcated wire receiving end portion positioned along one side of said ridge with the slot between the legs thereof extending transversely to said ridge, and a forked connecting member positioned on the other side of said ridge and extending through said openings in said insert and beyond the side of the insert opposite the ridge, and a cap positioned over said ridge and having side walls and a top wall, the side wall along one side of the cap extending along and parallel to the bifurcated end portions of the contacts and the opposite side wall being positioned parallel to the side-by-side openings, and the inner surface of the top wall capturing the contacts on ridge of said insert, whereby when the insert, contacts and cap assembly is positioned over the base, said bifurcated end portions engage the wires held by said wire retaining members and make an electrical connection with the wires and capture the wires between the base and wire assembly, and said forked connecting members extend from the base through said row of openings to make connection with another connecting member.

8. A multiple wire-splice module according to claim 8 wherein said module comprises means for making connection with the contacts of a 710 connector through the bridging slots thereof, said means including a bridging strip having opposite longitudinal surfaces and having a plurality of bridging contacts each with a forked connecting member positioned in a plane parallel to the length of the bridging strip, and a connecting tab positioned in a plane parallel to the length of said strip, said bridging strip comprising a first elongated support strip having means for accommodating a plurality of spaced bridging contacts and a mounting strip adapted to mate with said support strip for holding said bridging contacts in place with said forked connecting members extending from one surface thereof and with said connecting tabs positioned in slotted openings formed on the opposite surface thereof.

9. A multiple wire-splice module according to claim 7 wherein said cap has a row of openings formed in the top wall and positioned along said opposite side wall of said cap, said plurality of contacts are each formed with a connection tab extending in a plane in angular relationship to the plane of said forked connecting members of said contacts, said connection tabs being disposed in said row of openings in said cap.

10. A multiple wire-splice module according to claim 9 wherein said row of openings in said cap are adapted to receive a forked connecting member of a second wire-splice module.

11. A multiple wire-splice connector comprising a plurality of splice modules, each comprising:

an elongate base formed of an insulating polymeric material having opposite longitudinal sides with a row of slotted openings extending through said base along one side and wire retaining members positioned along the opposite edge with channels formed therebetween for receiving the wires, said channels for retaining the wires being aligned with the slotted openings positioned along the opposite side, an elongate insert having a plurality of side-by-side openings extending therethrough and means defining a ridge for supporting contacts, said ridge extending the length of said insert along one side thereof, a plurality of contacts supported on said ridge of said insert, each said contact having a bifurcated wire receiving end portion having a slot formed by narrow edges of two legs and being positioned along one side of said ridge with the slot defined by said edges extending transversely to said ridge, and a forked connecting member positioned on the other side of said ridge and extending through said openings in said insert and beyond the side of the insert opposite the ridge, and a connection tab extending in a plane in angular relationship to the plane of said forked connecting members of said contacts, a cap positioned over said ridge and having side walls and a top wall, a row of openings in the top wall allowing access to said connection tabs, the side wall along one side of the cap extending along and parallel to the bifurcated end portions of the contacts and the opposite side wall being positioned parallel to the side-by-side openings, and the inner surface of the top wall capturing the contacts on the ridge of said insert, whereby when the insert, contacts and cap assembly is positioned over the base, said bifurcated end portions engage the wires held by said wire retaining members and make an electrical connection with the wires and capture the wires between the base and insert, contacts, and cap assembly, and said forked connecting members extending from the base through said slotted openings being adapted to make connection with another connection tab, and a bottom cover and a top cover for enclosing the exposed forked connecting member and the row of openings in a cap respectively, said bottom cover and said cap having recesses along one side wall and an adjacent surface for receiving a separation tool to separate a bottom cover from a base or a top cover from a cap, whereby a pair of modules connected to the wires of a pair of cables can be spliced together by connecting the connecting members of one module to the connection tabs of the other module and placing the covers onto the cap of one module and the base of the other module.

* * * * *

UNITED STATES PATENT AND TRADEMARK OFFICE

CERTIFICATE OF CORRECTION

PATENT NO. : 5,147,218

DATED : September 15, 1992

INVENTOR(S) : Gary B. Matthews
Jerome A. Pratt

It is certified that error appears in the above-indentified patent and that said Letters Patent is hereby corrected as shown below:

On the Title Page, column 2, Primary Examiner's middle initial should be --L--

Column 11, Line 41 , "claim 8" --should read claim 7--

Signed and Sealed this

Seventeenth Day of January, 1995

*Attest:*

Bruce Lehman

BRUCE LEHMAN

*Attesting Officer*

*Commissioner of Patents and Trademarks*